US005489088A

United States Patent [19]

Warter

[11] Patent Number: 5,489,088

[45] Date of Patent: Feb. 6, 1996

[54] POST CLAMP

[76] Inventor: Stephen W. Warter, 6900 Hovingham Ct., Centreville, Va. 22020

[21] Appl. No.: 292,978

[22] Filed: Aug. 22, 1994

[51] Int. Cl.[6] ..... B25B 1/20

[52] U.S. Cl. ..... 269/41; 269/249; 269/904

[58] Field of Search ..... 269/37, 41, 43, 269/45, 42, 246, 249, 904

[56] References Cited

U.S. PATENT DOCUMENTS

| | | | |
|---|---|---|---|
| D. 135,081 | 9/1942 | Breuner . | |
| 1,175,392 | 3/1916 | White . | |
| 1,345,177 | 6/1920 | Heckathorn . | |
| 1,452,384 | 4/1923 | Kissendorfer . | |
| 1,474,119 | 11/1923 | Robertson . | |
| 1,908,748 | 5/1933 | Grant . | |
| 2,187,642 | 4/1939 | Brown . | |
| 2,606,583 | 8/1952 | O'Connor . | |
| 2,636,527 | 4/1953 | Schiemann . | |
| 2,680,459 | 6/1954 | Dodson et al. | 269/41 |
| 2,907,238 | 10/1959 | White . | |
| 4,350,318 | 9/1982 | Gallis . | |
| 5,090,670 | 2/1992 | Yang . | |
| 5,190,270 | 3/1993 | Huston | 269/41 |

*Primary Examiner*—Robert C. Watson
*Attorney, Agent, or Firm*—Dowell & Dowell

[57] ABSTRACT

A clamp suitable for securing a support post to a structural member of a railing such as may be associated with a deck is disclosed. The clamp includes an outer bracket movably connected to an inner bracket, and a clamping bolt. The clamp is secured to a structural member such as a joist or fascia strip by adjusting the position of the outer bracket relative to the inner bracket using the clamping bolt. With the clamp secured, the user has both hands free to position the support post within the clamp and adjacent to the structural member. In a second clamping movement, the clamping bolt is utilized to clamp the support post to the structural member.

17 Claims, 4 Drawing Sheets

POST CLAMP

BACKGROUND OF THE INVENTION

The invention is directed to the field of clamps and, more particularly, to a clamp suitable for securing a support post to a structural member of a railing such as may be associated with a deck.

The construction of a residential deck is a difficult project for a single individual. Throughout the construction, it is necessary to hold components of the deck together until being permanently secured by fasteners. When the member to be secured to a fixed member is large or heavy, one individual usually is unable to hold both members together, and simultaneously form holes in the members and insert the fasteners.

Adding to the difficulty of constructing a railing of a deck or other structure is the desirability of forming a plumb and level structure, which relates to the manner in which the structural members are secured together. For example, horizontal structural members must be level to provide a level surface for attaching the flooring, and the railing support posts must be vertically plumb to provide a level surface for attaching the railings. Railing support posts are typically cumbersome and difficult for one individual to handle. Consequently, an individual may not be able to adequately hold the structural members together for alignment.

In view of the above-described problems associated with constructing a railing for a deck by a single individual, additional persons are usually required to complete such tasks, which increases the cost of the structure. It may also be undesirable from the perspective of a professional contractor to assign extra employees to such projects, in that it takes persons away from other projects.

For the foregoing reasons, there has been a need for a device which simplifies the construction of railings and enables one individual to complete the construction. There has particularly been a need for a device which can be used by an individual to clamp and fasten together two structural components of a railing while having free use of both hands.

SUMMARY OF THE INVENTION

The present invention has been made in view of the above-explained inadequacies of the known clamps and has as an object to provide a clamp device which is suitable for clamping a railing support post to a structural member of a deck or other structure.

Another object of the invention is to provide a clamp device which enables a single individual to easily clamp and fasten together a railing support post and a structural member of a deck or other structure.

Additional objects and advantages of the present invention will become apparent from the description which follows, considered in conjunction with the accompanying drawing figures, or by practice of the invention.

To achieve the objects of the invention, as embodied and broadly described herein, the clamp in accordance with a preferred embodiment of the invention comprises an outer bracket and an inner bracket movably connected to the outer bracket.

The inner bracket includes a first portion which is surrounded by the outer bracket. The first portion has opposed side walls, and a second portion integral with each side wall. The second portions define an upwardly opening space for receiving a first structural member, and a base portion connects the second portions. In use, a second member such as a railing support post is positioned within the first portion and supported by the base portion.

The clamp further comprises a bolt extending through the inner and outer brackets. The bolt includes a clamping head disposed interiorly of the inner bracket, a threaded portion, a nut disposed on the threaded portion exteriorly of the outer bracket, and a grip portion disposed outwardly from the nut. The nut is rotatable to move the outer bracket into contact with the first structural member and the grip portion is rotatable to move the clamping head into contact with the support post and the support post into clamping engagement with the first structural member.

DETAILED DESCRIPTION OF THE PREFERRED EMBODIMENT

Figure 1:
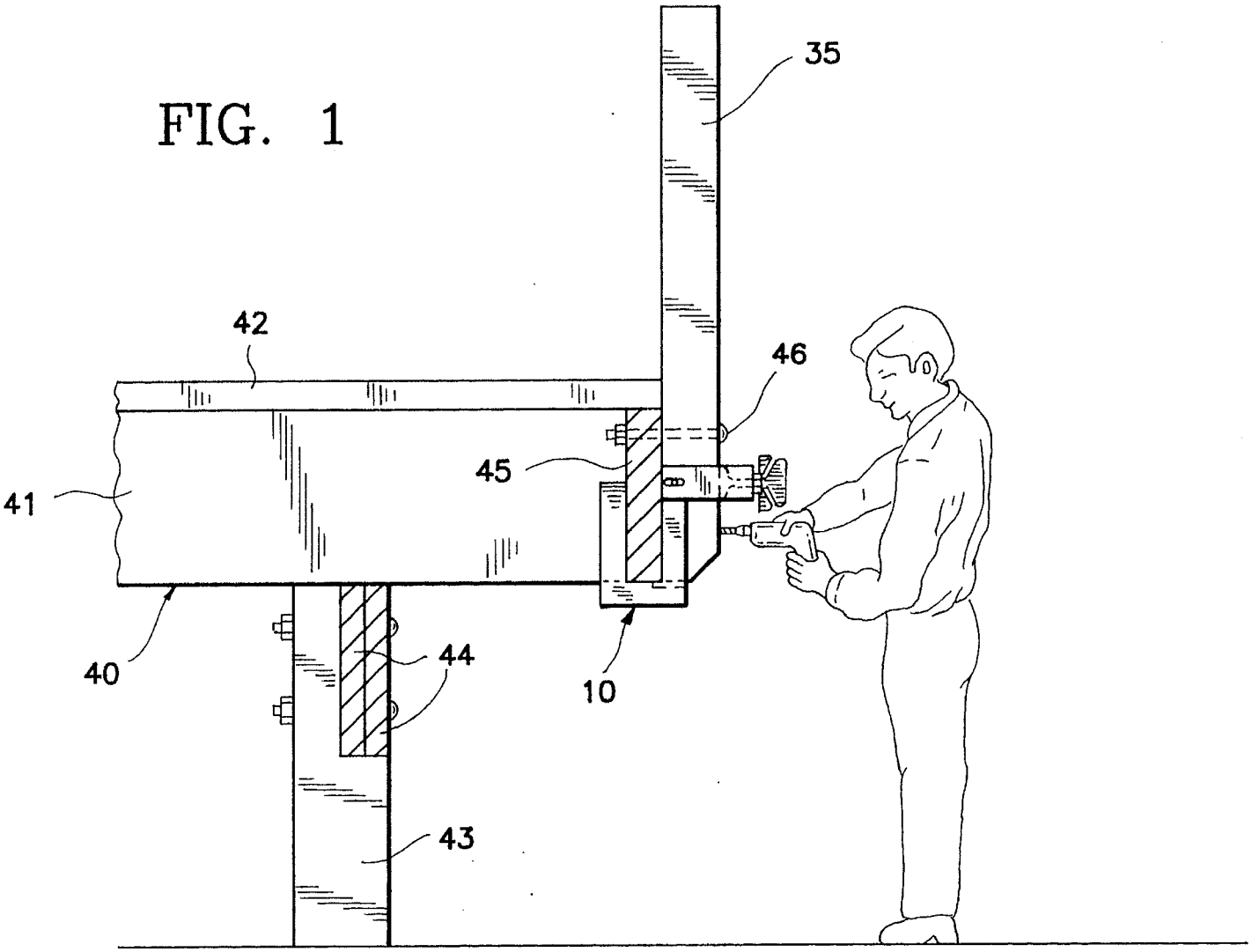
FIG. 1 is an illustrational view depicting the manner of use of the post clamp in accordance with a preferred embodiment of the invention in the construction of a deck.

A preferred embodiment of the invention will now be described in detail with reference to the drawing figures.

FIG. 1 illustrates the manner of use of a post clamp 10 in accordance with the invention to temporarily secure a railing support post 35 to a deck 40. The illustrated deck includes a joist 41, flooring 42, deck support post 43, girders or beams 44 and fascia strip 45. The clamped railing support post is permanently secured to the deck by fasteners such as bolts 46 inserted in bores formed in the post and fascia strip. The posts may be likewise secured to the joists.

Figure 2:
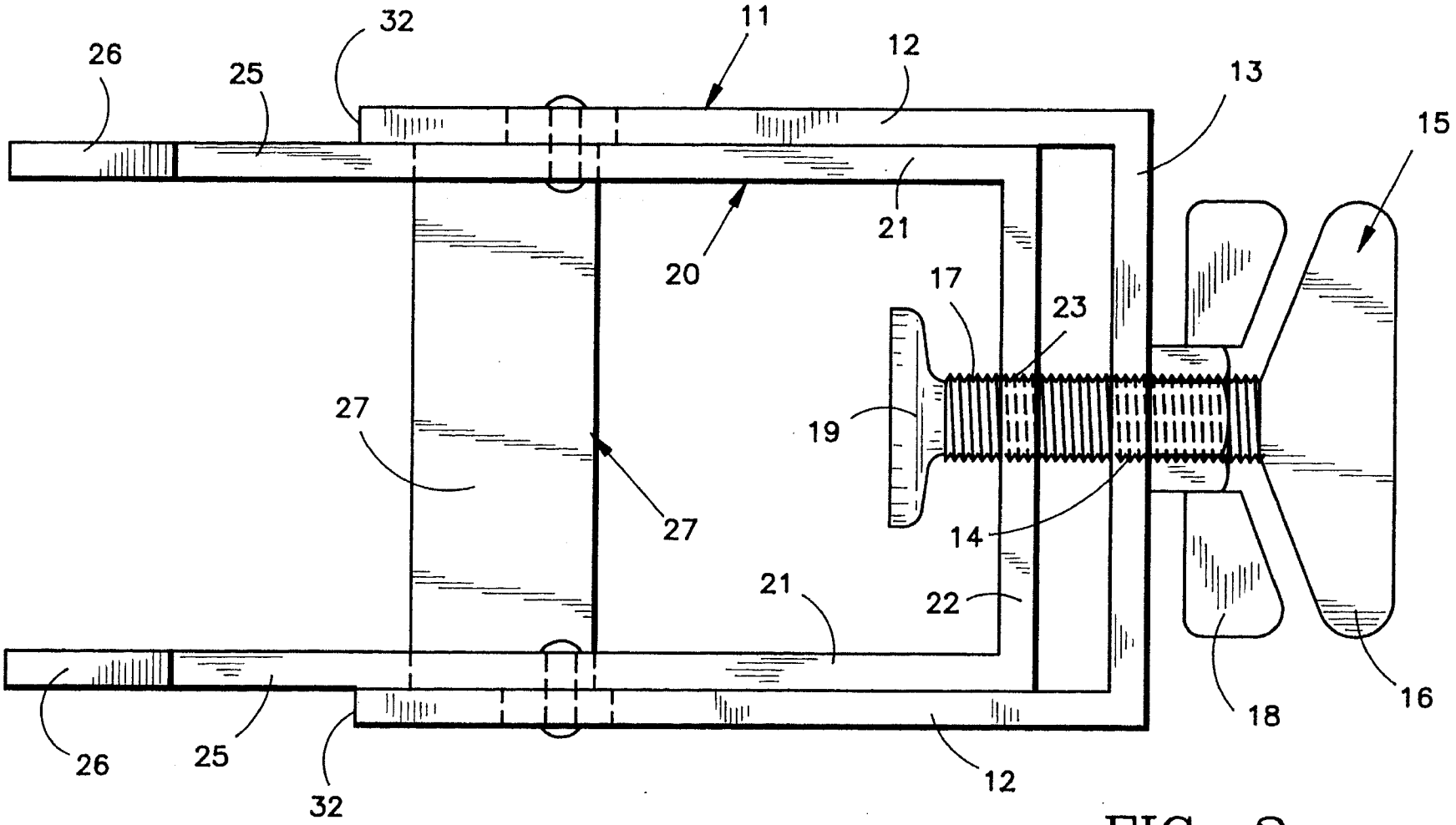
FIG. 2 is a top plan view of the post clamp in accordance with a preferred embodiment of the invention.

Referring to FIG. 2, the post clamp 10 in accordance with the invention comprises an outer substantially U-shaped bracket 11 having a pair of opposed side walls 12 and a rear wall 13. The rear wall includes a bore 14 which freely receives a bolt 15 having a handle 16 at its outer end, a central threaded portion 17 and a clamping head 19 at its inner end. A wing nut 18 is adjustably mounted on the threaded portion 17 of the bolt.

The post clamp 10 further comprises an inner bracket 20 including a pair of opposed upper side walls 21 and a rear wall 22 nested within the outer bracket 11. The rear wall includes a threaded bore 23 which is aligned with bore 14 and which cooperatively engages the threaded portion 17 of bolt 15.

Figure 4:
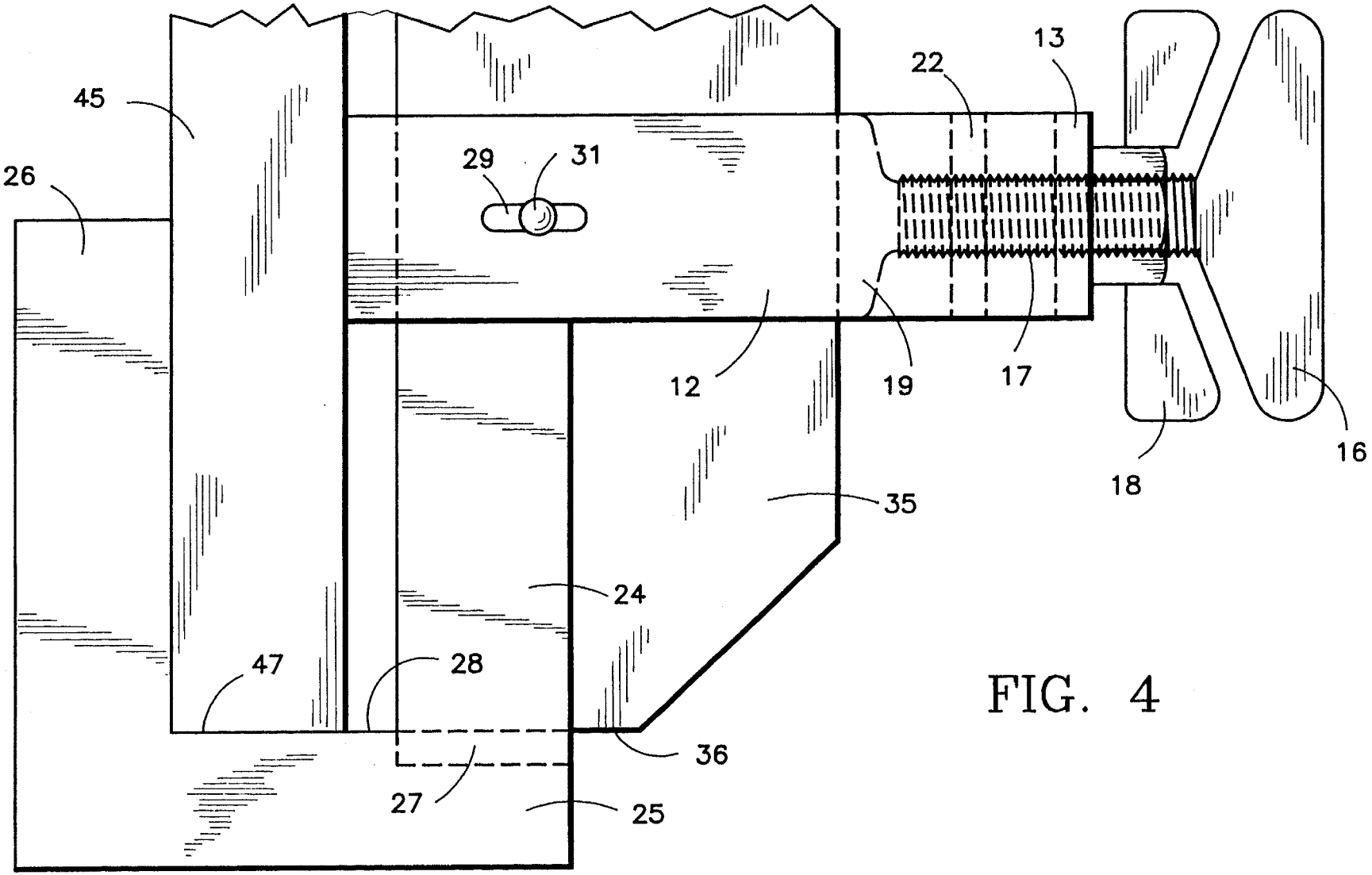
FIG. 4 is a side elevational view of the post clamp of FIG. 3.

With reference to FIG. 4, inner bracket 20 further comprises a substantially U-shaped portion integral with each upper side wall 12. The U-shaped portions each include a first vertical wall 24 which extends downward from an upper side wall 12, a lower side wall 25, and a second vertical wall 26 which extends upward from the lower side wall parallel to the first vertical wall. The first and second vertical walls and the lower side walls define a space therebetween for receiving the structural member. As illustrated in FIG. 2, the lower side walls are connected by a horizontal base portion 27.

Each of the inner and outer brackets preferably are integrally formed components. Both brackets may be composed of a metal or plastic material.

The outer bracket 11 can be moved in the longitudinal direction of the clamp relative to the inner bracket 20. As illustrated in FIG. 4, the side walls 12 of the outer bracket each include an elongated slot 29, and the upper side walls 21 of the inner bracket each define a circular bore 30 in communication with an elongated slot. A pin such as rivet 31 extends through each aligned elongated slot and bore and is secured to the respective outer and inner brackets. The pin is fixed relative to the inner bracket and moves within the elongated slot.

Figure 3:
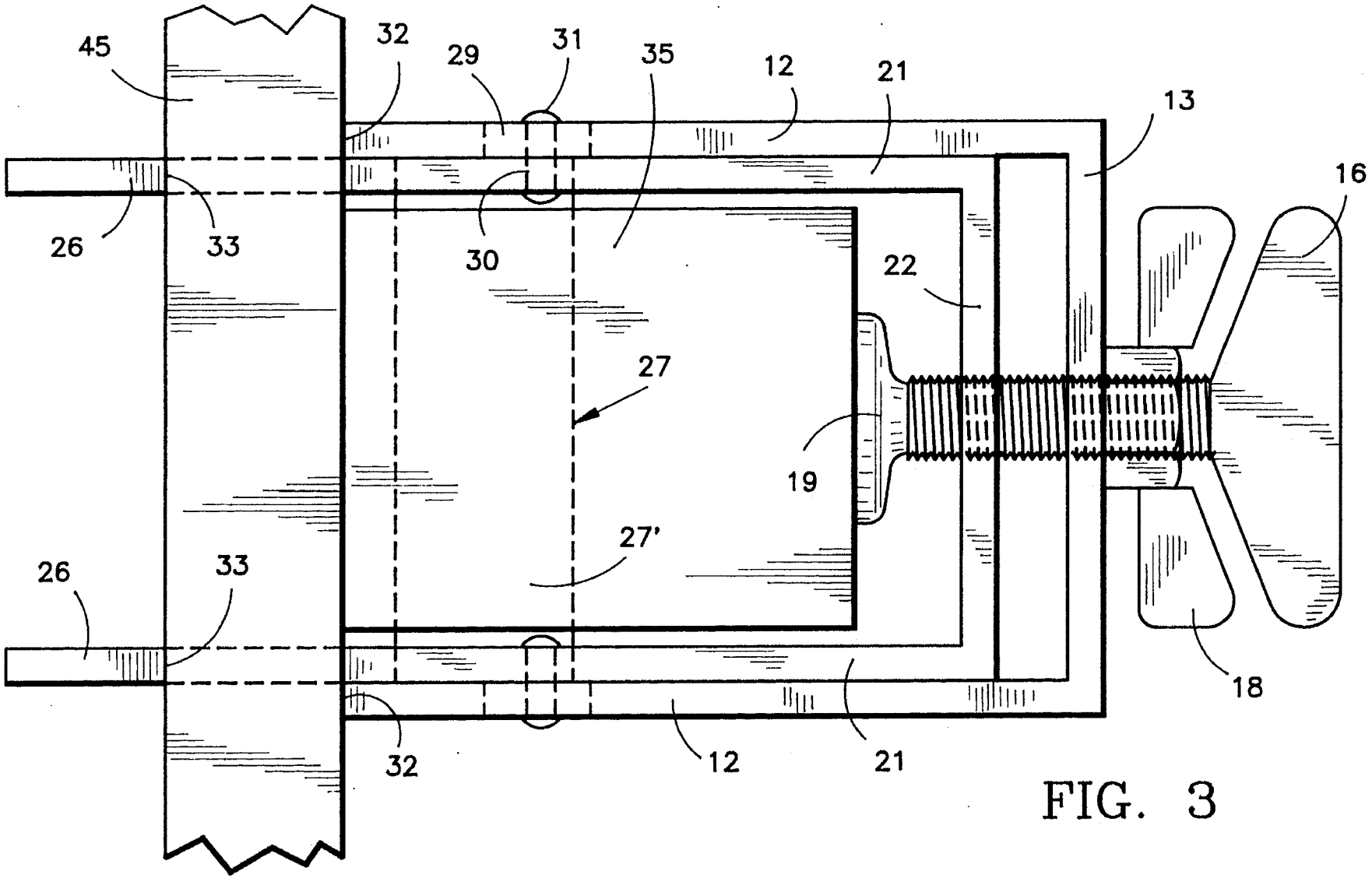
FIG. 3 is a top plan view of the post clamp in accordance with a preferred embodiment of the invention secured to a structural member.

The manner of use of the post clamp 10 to secure a railing support post 35 to a fascia strip 45 will now be described with reference to FIGS. 3 and 4. The post clamp is initially fitted about the fascia strip such that the upper surface 28 of each lower side wall 25 contacts the bottom surface 47 of the fascia strip. Holding the clamp in this position, the wing nut 18 is rotated to move the front faces 32 of the outer bracket forward until they abut the fascia strip. Further rotation of the wing nut moves the fascia strip into contact with faces 33 of the second vertical walls 26 and firmly secures the post clamp to the fascia strip.

The post clamp provides the advantage that when it is secured to the fascia strip or other structural member, an individual constructing the deck has both hands free to position the railing support post 35 between the fascia strip 45 and the retracted clamping head 18 of bolt 15 such that the lower surface 36 of the post rests on the upper surface 27' of the horizontal base portion 27. The individual then performs a second clamping movement by rotating the handle 16 of the bolt to move the clamping head 18 against the post and, with continued rotation, into loose engagement with the fascia strip.

Next, the vertical orientation of the railing support post is adjusted before it is fastened to the fascia strip. The post can be adjusted using a conventional leveling tool to ensure a level deck construction. After the post is properly positioned, the bolt 15 is rotated to firmly clamp the post to the fascia strip.

To permanently secure the railing support post to the fascia strip, usually two holes are drilled through the post and fascia strip and fasteners are inserted in the holes. To attach additional railing support posts to the deck, the clamp is simply disengaged and reattached at another position along the deck, and the post fastening process is repeated.

The post clamp in accordance with the invention preferably is sized for use with structural members having a nominal thickness of 1½", such as the fascia strips conventionally incorporated into decks. The first and second vertical walls, 24, 26, respectively, are preferably spaced by a distance slightly greater than 1½" to receive such structural members.

In addition, the post clamp is preferably designed such that when the outer bracket 11 is brought into contact with the structural member by the first clamping movement, the retracted clamping head 18 is spaced from the fascia strip by a distance greater than the nominal thickness of a 4"×4" railing support post or approximately 3½"×3½".

It will be understood by those skilled in the art, that the post clamp in accordance with the invention can be used for applications other than attaching railing support posts to residential decks. For example, the post clamp may be used to construct other types of decks and platforms, as well as fences. For such applications, the size of the post clamp may be varied.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. A clamp for securing a first member to a second member, the clamp comprising:

a first bracket:

a second bracket movably connected to said first bracket, said second bracket including a first portion having opposed side walls, a second portion connected to each said side wall and defining an upwardly opening space for receiving the first member, and a base portion connecting the second portions, the second member being positionable within said first portion and supportable by said base portion; and a bolt extending through said first and second brackets, said bolt including a clamping head disposed between said opposed side walls of said second bracket, a threaded portion, a nut disposed on said threaded portion exteriorly of said first and second brackets, and an outer portion disposed outwardly from said nut, said nut being rotatable to move said first bracket relative to said first portion of said second bracket and into contact with the first member when received in said U-shaped space, and said outer portion of said bolt being rotatable to move said clamping head into contact with the second member when received in said first portion and to move the second member into clamping engagement with the first member.

2. The clamp of claim 1, further comprising means for slidably connecting said first and second brackets relative to one another.

3. The clamp of claim 2, wherein said first bracket comprises a pair of opposed side walls each having a slotted opening therein, said means for slidably connecting includes a pin extruding from said side walls of said first portion of said second bracket, said pin extending through each of said slotted openings.

4. The clamp of claim 2, wherein said first bracket comprises an outer rear wall having a bore therein, said first portion of said second bracket comprises an inner rear wall having a threaded bore therein, said bolt extends through said bore in said first bracket and said threaded portion engages said threaded bore of said second bracket.

5. The clamp of claim 4, wherein said first bracket and said first portion of said second bracket are substantially U-shaped.

6. The clamp of claim 5, wherein each of said second portions of said second bracket comprises a first vertical wall extending downwardly from each of said sidewalls, a lower side wall extending forwardly from each of said first vertical walls, a second vertical wall extending upwardly from each said lower side wall and substantially parallel to said first vertical wall, said first and second vertical walls and said lower side wall defining said space therebetween.

7. The clamp of claim 6, wherein said nut is a wing nut and said outer portion of said bolt is a handle.

8. The clamp of claim 6, wherein said first portion of said second bracket is received between said side walls of said first bracket.

9. A clamp for securing a first member to a second member, the clamp comprising:

an outer bracket having a pair of outer side walls each having a slotted outer opening, and an outer rear wall